United States Patent [19]

Brewer et al.

[11] 3,988,903

[45] Nov. 2, 1976

[54] DUAL ACTING DEFROST SYSTEM FOR ICE MAKERS AND CONTROLS THEREFOR

[75] Inventors: Jimmy Milton Brewer, Fort Smith; John Thomas Tindle, Van Buren, both of Ark.

[73] Assignee: Refrigerated Products, Inc., Fort Smith, Ark.

[22] Filed: Mar. 14, 1975

[21] Appl. No.: 558,365

[52] U.S. Cl. ..... 62/138; 62/73; 415/17; 62/352

[51] Int. Cl.[2] ..... F25C 1/12

[58] Field of Search ..... 62/352, 349, 138, 282, 62/73; 200/81.6; 415/17; 417/279; 137/557

[56] References Cited

UNITED STATES PATENTS

| | | | |
|---|---|---|---|
| 2,592,314 | 4/1952 | Morton | 137/387 |
| 3,068,660 | 12/1962 | Council et al. | 62/352 X |
| 3,164,968 | 1/1965 | Mullins, Jr. | 62/352 X |
| 3,334,651 | 8/1967 | Clearman | 137/387 X |
| 3,392,540 | 7/1968 | Council et al. | 62/352 X |
| 3,791,163 | 2/1974 | Dickson et al. | 62/347 |

*Primary Examiner*—William E. Wayner
*Attorney, Agent, or Firm*—Robert Brown, Jr.

[57] ABSTRACT

A reversible cycle ice making machine provided with a tube-in-tube evaporator having disposed between the tubes thereof an annular chamber through which a refrigerant is adapted to flow and bond a hollow ice column upon the inside surface of the inner tube during the freezing cycle; and during the succeeding defrost cycle, to thaw the bond by a dual acting defrost system.

One of the defrost actions of the system is effected by flowing a defrost fluid, such as hot gas, endwise through the annular chamber to cause the refrigerant remaining the chamber from the preceding freezing cycle to be progressively replaced by the defrost fluid while the ice column bond is progressively thawed in the endwise direction. Thus, the length of the chamber containing the defrosting fluid progressively increases as the complementary length containing the remaining refrigerant fluid decreases during the flow of both fluids in tandem and downstream through the chamber.

The other defrost action is effected concurrently with the first action by continuously flowing a second defrost fluid, such as city water, over the outer evaporator tube to elevate the temperature of the complementary refrigerant remaining in the chamber from the preceding freezing cycle and also to elevate the reduced temperature of the first defrost fluid, thereby diminishing the work load of the first defrost fluid to shorten the defrost cycle.

9 Claims, 7 Drawing Figures

DUAL ACTING DEFROST SYSTEM FOR ICE MAKERS AND CONTROLS THEREFOR

The invention is further characterized by three types of defrost controls especially adapted for use in combination with the dual acting system under specified conditions so as to increase the operating efficiency and further reduce the duration of the defrost cycle.

This invention relates to ice making apparatus having a tube-in-tube evaporator wherein ice is frozen on the inside surface of the inner tube from water continuously flowing therethrough, the apparatus being generally similar to the types disclosed in the Bussell U.S. Pat. No. 3,247,647 and the Council U.S. Pat. No. 3,392,540.

It is a wellknown fact that the above-mentioned types of prior art icemakers cause hot gas to flow from the compressor and longitudinally through the annular space between the tubes during the defrosting cycle to thereby release the column of ice formed in and throughout the length of the inner tube during the immediately preceding freezing cycle. Due to the limited charge of hot gas usually present in these evaporators and to the rapid heat absorption by the ice, the temperature and its defrosting effect are quickly lowered during the initial part of the cycle, resulting in the portion of the ice column nearest the hot gas inlet becoming released from the inner tube while the more remote portion remains bonded. It is not until the temperature at the remote portion builds up over an additional period of time that the entire column length becomes becomes released.

It is therefore an object of this invention to provide a dual acting defrost system which will obviate the aforementioned drawback and shorten the duration of the defrost cycle.

It is another object of this invention wherein the abovementioned delayed effect of the defrosting fluid at the remote portions of the ice column is quite substantially shortened by spraying relatively a low temperature fluid upon the remote portions while the high temperature fluid defrosts the portions of the column near the gas inlet.

It is another object of this invention to provide a dual acting defrost system of the class described in which the defrost cycle is initiated and controlled by a solid state switching device which is responsive to a water level sensing means at the discharge outlet of the evaporator. The solid state control, when properly installed in the system, is very reliable and relatively maintenance free, due primarily to the fact that the relay contained in the device is the only moving part eliminating the necessity for making adjustments in the field. Other switching devices performing a similar function generally require field adjustments which are often made by untrained personnel, creating defective operation and breakdowns. Moreover, many of such other devices develop memory or, in effect, bend, give or wear.

It is a further object of this invention to provide a defrost system of the class described in which the defrost cycle is initiated and controlled by a pressure switch which is responsive to the water pressure at its point of entry into the evaporator, but which is insulated from the water itself by an intermediate column of air which damps the vibrations normally imparted to the switch by sudden stoppage of the water flow and also serves to eliminate the buildup of water impurities in the line and cause the control to become gummed up and inoperative in localities where the water contains minerals or other matter causing the buildup. Again, there are no moving parts in this particular control mechanism except the bellows or diaphragm operated by the air pressure. With pressure, the switch is closed; without pressure, it is open.

It is yet another object of this invention to provide a dual acting defrost system for tube-in-tube evaporators of ice making machines, wherein the defrost cycle is initiated and controlled jointly by the pressure and temperature of the water between the pump outlet and the evaporator inlet. A predetermined high water pressure at the pump outlet, caused by the ice formation inside the inner tube during the freezing cycle, automatically causes a water relief valve to release a small quantity of water upon a thermal sensing bulb which, in turn, actuates a thermostat control to initiate the defrost cycle. This embodiment is advantageous where ice making machinery is located in areas where the temperature falls below 34° Fahrenheit. Should such a temperature drop occur, the thermal sensing control would continue the defrost cycle and prevent freezing damage.

Some of the objects of the invention having been stated, other objects will appear as the description proceeds when taken in connection with the accompanying drawings, in which, FIG. 1 is a diagrammatic view showing the mechanical and electrical components of a dual acting defrost system according to the invention, in combination with a solid state control device and water level sensing means which jointly control the defrost cycle;

PRIOR ART

Figures 1, 1A, 1B, 2:
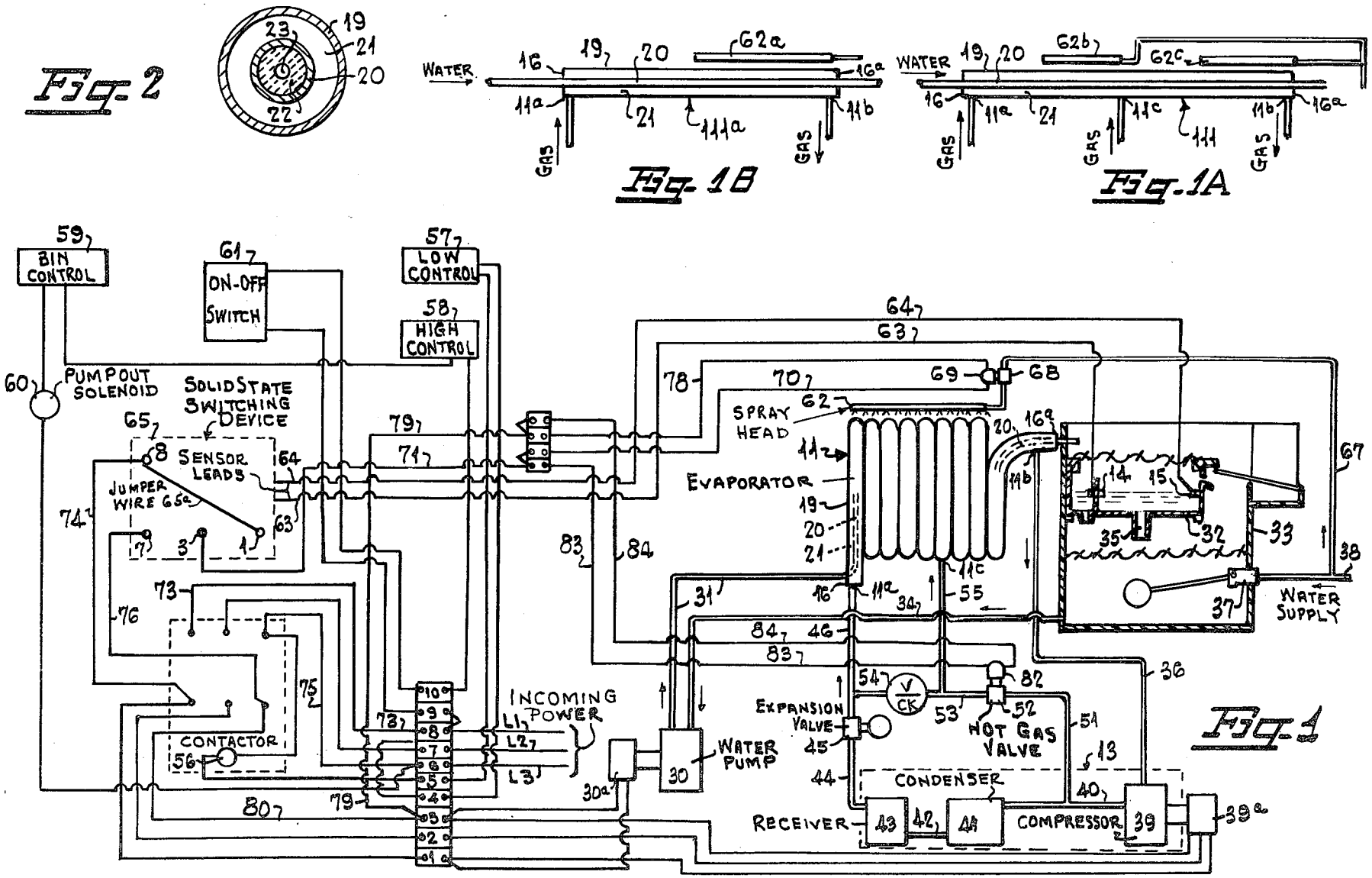
FIGS. 1A and 1B are schematic illustrations of modifications of portions of the defrost system.
FIG. 2 is an enlarged cross-sectional view taken through the tube-intube evaporator, showing an ice deposit or column formed within the inner tube.

The present invention is adapted to operate in conjunction with a conventional reversible cycle ice making apparatus having a tube-in-tube evaporator 11, a water pump 30 with a motor **30*a*, a water makeup tank 33, an assembly 13 consisting of compressor 39, condenser 41 and receiver 43, a hot gas valve 52, and a check valve 54, the aforementioned elements being equipped with electrical control equipment such as contactor 56, low control 57, high control 58, bin control 59, pumpout solenoid 60 and on-off switch 61**. The electrical control equipment is connected to incoming power lines L1, L2 and L3 in a wellknown manner.

The evaporator 11 includes an outer tube 19 which is supported at its opposite ends 16 and **16*a* by a concentric inner tube 20, said tubes being provided with an annular elongated space 21 therebetween which serves as a conduit through which a refrigerant flows during the freezing cycle to cause the formation of a cylindrical ice column 22 on the inside wall of the inner tube from water flowing through the latter tube (FIG. 2). Space 21 also serves as a conduit for the passage of a hot gas refrigerant during the succeeding defrost cycle to thereby thaw the bond between the deposit 22 and tube 20** whereby the deposit may be expelled by the water pressure.

Compressor 39 functions to keep the refrigerant in circulation; condenser 41, through cooling, changes the hot high pressure gas to a cooler high pressure liquid, and receiver 43 stores the excess refrigerant until needed by the evaporator 11.

During operation of the ice making apparatus, water to be frozen flows in an orbital path which consists of pipe conduit 31, inner evaporator tube 20, escrow pan 32 having a sized orifice 35 in the bottom thereof, makeup tank 33, suction conduit 34 and pump 30. Float assembly 37 controls the supply of water through pipe 38 into tank 33.

The water and refrigerant flow unidirectionally through the evaporator 11 during the freezing cycle and, as the the ice column 22 within the inner tube 20 becomes thicker, the size of the water passageway through the column becomes correspondingly smaller to thereby increase the water pressure between the pump and evaporator. From the space 21, the refrigerant flows through conduit 36, compressor 39, conduit 40, condenser 41, conduit 42, receiver 43, conduit 44, expansion valve 45, conduit 46 and again into annular space 21 as at 16. The metering by expansion valve 55 creates a pressure drop, causing the refrigerant to boil and form a gas as it enters space 21. Check valve 54 prevents reverse flow of the refrigerant through line 53.

After the ice formation 22 in tube 23 has restricted the water flow through passageway 23 to increase the water pressure a predetermined amount, the freezing cycle is automatically terminated by opening valve 52, at which time the defrost cycle begins. During the latter cycle, hot gas flows from compressor 39, through conduits 51, 53 and 46 and into space 21 as at **11*a* and also into space 21 through conduit 55 at point 11*c***.

It is important to note that, for the duration of the defrost cycle, the temperature of the hot gas and its rate of thawing the ice column in the inner tube 20 each progressively decreases over the distance from point **11*a* to point 11*c*. At the latter point, the depleted hot gas which entered at point 11a merges with an additional supply of hot gas to raise the temperature, after which the temperature of the merged streams of gas progressively decreases from point 11*c* to discharge outlet 11*b*. resulting in a corresponding decrease in the rate of thawing of the ice bond between column 22 and tube 20. Consequently, the ice bond of column 22 will be released progressively from point 11a toward point 11c during the cycle, and likewise, the bond will also be progressively released from point 11*c* toward point 11*b***. The duration of the defrost cycle is determined by the minimum time necessary for the bond to become thawed over the entire length of the column.

THE INVENTION

The dual acting defrost system according to the present invention comprises: on one hand, a novel cooperative relationship between the low temperature defrosting spray head or mechanism 62 and the above-described hot gas defrost mechanism and, on the other hand, a further novel cooperative relationship between these two mechanisms and specific controls such as the liquid level solid state switching device 65 (FIG. 1), the air cushioned pressure control assembly 85 (FIGS. 3 and 4), and the thermally sensed water pressure switch assembly 86 (FIG. 5), each of which is adapted to provide optimum performance under certain operating conditions.

In order to substantially reduce the delay in the thawing of the bonds between tube 20 and the portions of the ice columns remote from the hot gas inlets (that is, the upstream portions adjacent points **11*c* and 11*b*), the low temperature defrost spray is employed with at least such remote portions at the same time the downstream column portions adjacent points 11*a* and 11*c* are progressively defrosted endwise and in the direction of flow of the high temperature gas. More particularly, FIGS. 1A and 1B illustrated how this limited application of the low temperature defrost may be effected. FIG. 1A shows an evaporator 111 in which the initially cooler upstream portions of the ice column adjacent points 11*c* and 11*b* are provided with separate low temperature spray heads 62*b* and 62*c*, whereas, the column portions downstream from points 11*a* and 11*c* rely only upon the hot gas defrost action during the defrost cycle. FIG. 1B shows an evaporator 111*a* in which only one gas inlet 11a is provided which defrosts the downstream portion of the ice column from this point while the low temperature spray head 62a defrosts the column portion upstream from point 11*b***.

In regard to the low temperature spray head 62 (FIG. 1), it will be observed that a low temperature fluid (usually city water) flows substantially uniformly over the outer tube 19, preferably for the entire length of the evaporator during the defrost cycle, said fluid coming from supply conduit 38 by way of conduit 67 and solenoid valve 68. The admission of the low temperature fluid into the spray head is controlled by the valve and a solenoid 69 connected from one side to terminal 3 of solid state device 65 by conduits 70 and 71, and from its other side to terminal 7 of the device by conduits 78, 79, 80 and 76.

The gas valve 52 is operated by its solenoid 82 simultaneously with the operation of the above-described low temperature defrost apparatus. One side of solenoid 82 is connected to terminal 3 of device 65 by conduits 83 and 71, and the other side to terminal 7 of the device by conduits 84, 79, 80 and 76.

The solid state device is responsive to water level sensors 15 and 15 disposed at the same level in plastic escrow pan 32, said sensors being connected to the device by leads 63 and 64. Device 65 is conventional, per se, but when combined with water level sensors and the above-described high and low temperature defrost apparatus, it eliminates the sluggish performance inherent in most conventional controls used on icemakers, eliminates electrolysis at the sensors, and is practically free from field adjustment and maintenance, thus improving the operating efficiency and increasing ice production. Furthermore, the extremely sensitive operation of the device further reduces the duration of the defrost cycle.

The solid state switching device 65 is commercially available at the Ranco Controls Division, 601 West Fifth St., Columbus, Ohio 43202 and designated as Rancostat E24-2404 with the following specifications:

240 volts, 60 cycles;

Contact Rating - Motor Amps:

| Volts | Full Load | Locked Rotor |
|---|---|---|
| 120 | 8 | 48 |

-continued

| Volts | Full Load | Locked Rotor |
|---|---|---|
| 240 | 4 | 24 |

Device 65 is constructed so as to provide low voltage sensing (preferably 30 volts) from high voltage power (preferably 230 volts) supplied from the incoming leads L1 and L3. Lead L1 is connected to terminal 8 of the device through conduits 73 and 74, and lead L3 is connected to terminal 7 of the device through conduits 75 and 76.

OPERATION

During the freezing cycle, the rate of flow of the water discharged from the evaporator into escrow pan 32 is always at least equal to the rate of water flow from the pan through the metered orifice 35 to thereby maintain the water level above the probes or sensors 14 and 15. When the increasing ice formation 22 in the evaporator tube 20 restricts the rate of water discharge into the pan a predetermined amount, the water level falls below the sensors to break the circuit 63, 65 leading to switching device 65. When this circuit is broken, the terminals 1 and 3 of the device are caused to engage to complete the circuits leading therefrom to the high and low temperature solenoids 82 and 69 which actuate hot gas valve 52 and solenoid valve 68, respectively, thereby initiating operation of the dual acting defrost system at the beginning of the defrost cycle.

The opening of solenoid valve 82 causes separate streams of hot gas to simultaneously enter the annular evaporator space 21 at points 11*a* and 11*c*, respectively, after which the temperatures of the respective streams, as well as the defrosting effects upon the bonded ice column 22, progressively decrease downstream from said entry points. As a consequence, only the downstream portions of the ice column adjacent the entry points 11*a* and 11*c* are initially defrosted to release the ice bond at the beginning of the defrost cycle. Stated conversely, the column portions disposed immediately upstream from points 11*c* and 11*b* are not initially defrosted because of their remoteness from the hot gas entry points 11*a* and 11*c*, respectively. The last-named remote column portions, however, are initially defrosted by the low temperature water discharging from the spray head 62 onto the outer surface of the evaporator, as previously described in detail in connection with FIGS. 1, 1A and 1B.

A comparison of the results obtained when using only the conventional high temperature gas defrosting apparatus described above, with the results obtained when concurrently employing this conventional apparatus in combination with defrost spray manifold 62 and strictly in accordance with FIGS. 1A, 1B, 3 and 4 will better illustrate the advantages of the dual acting defrost system according to the invention.

The ice column at the beginning of the defrost cycle is 10° below zero Fahrenheit; its bond to pipe or tube 20 releases at 34 degrees above. When the hot gas first enters the annular space 21 of the evaporator, it must be at 60 pounds pressure and 105° F. to defrost when using only the hot gas defrost apparatus previously described. With the entering defrost gas at the above temperature and pressure in the conventional hot gas defrost apparatus, at least 60 to 65 seconds are required to defrost the entire length of the ice column. When, however, city water at 70° F. or above is concurrently sprayed from spray head 62 uniformly upon the evaporator outer surfaces, the results are dramatic. Instead of the defrost cycle lasting from 60 to 65 seconds, it is reduced to 40 to 45 seconds, which is a reduction of at least 40 percent. Repeated tests on commercially operating machines have verified these improved results.

Figures 3, 4:
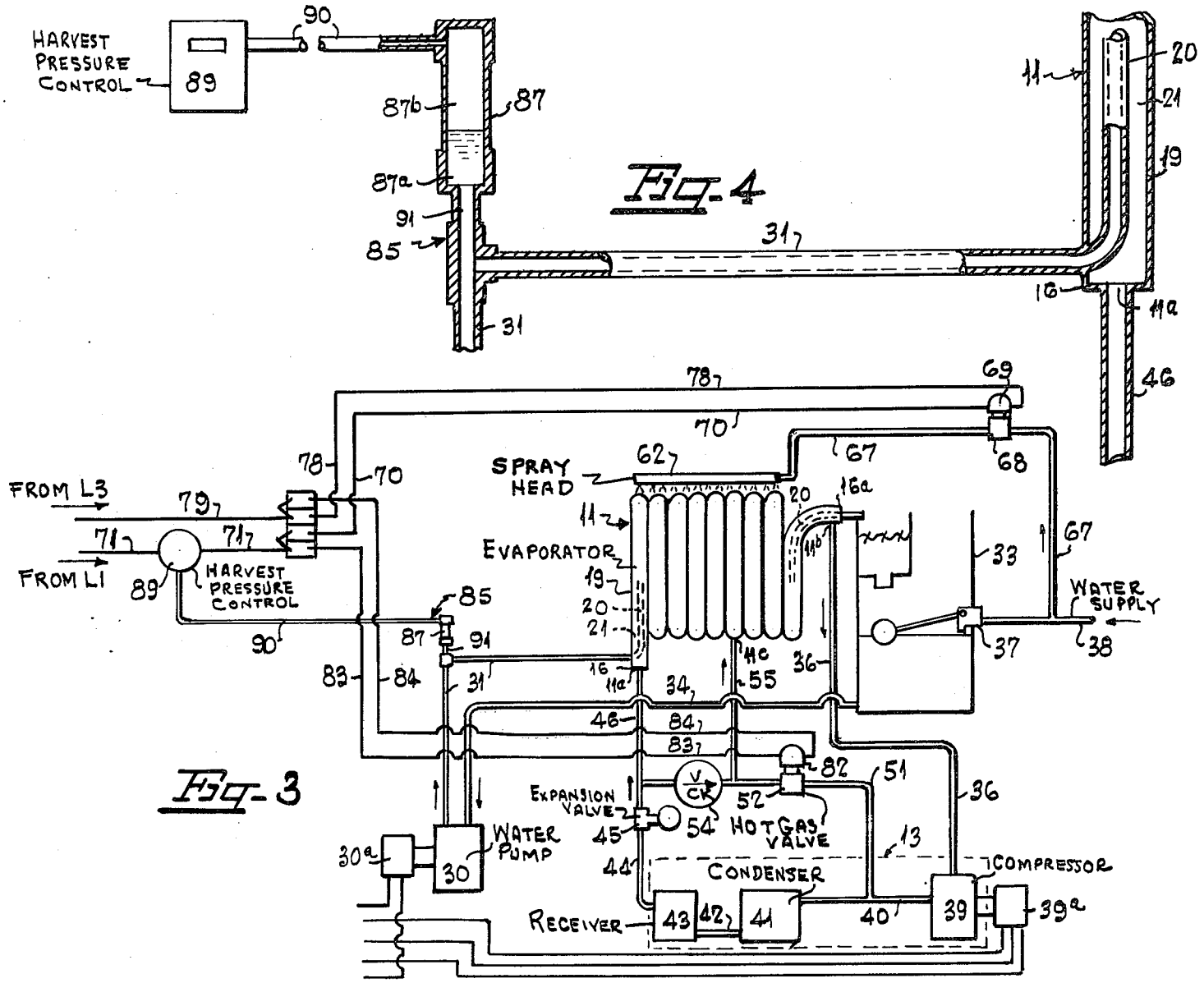
FIG. 3 is a diagrammatic view similar to FIG. 1, but illustrating a modified embodiment in which the defrost cycle is controlled by an air cushioned pressure switch assembly 85.
FIG. 4 is an enlarged sectional view showing details of the air cushioned pressure switch.

FIGS. 3 and 4 show a modified form of the invention which is substantially identical to the previously described embodiment in FIGS. 1 and 2 except an air cushioned pressure switch control assembly 85, responsive to the water pressure at the evaporator inlet, is employed instead of the solid state water level sensing control assembly.

Control assembly 85 includes a closed reservoir 87 having water space 87*a* at its lower portion and an air space 87*b* at its upper portion, and a harvest pressure control switch 89 communicating with the air space 89*b* by means of tube 90. The water space 87*a* communicates with the pressure line 31 between pump 30 and evaporator 11 through a short upstanding pipe 91, thereby subjecting the spaces 87*a*, 87*b*, tube 90 and the harvest pressure control switch 89 to the pressure in line 31. Switch 89 is connected to previously described hot gas valve solenoid 82 by means of conduits 71, 83, 84 and 79; and to spray head solenoid 69 by a parallel circuit consisting of conduits 71, 70, 78 and 79.

The harvest pressure control switch is commercially available at the above-mentioned Ranco Controls, Inc. and has the following specifications:

| Type 010 | Volts | FLA | LRA |
|---|---|---|---|
| Model 1401 | 120 | 20 | 120 |
| Close on Rise | 240 | 17 | 102 |

During operation, the water pressure in line 31 resulting from ice formation in the evaporator inner tube 20 compresses the air in chamber 87 to a point where the switch 89 closes. The closed contacts complete the electrical circuits to the hot gas defrosting valve solenoid 82 and the water spray solenoid 69 to initiate operation of the dual defrost system at the beginning of the defrost cycle. The assembly 85 possesses numerous advantage under special operating conditions as stated above.

Figure 5:
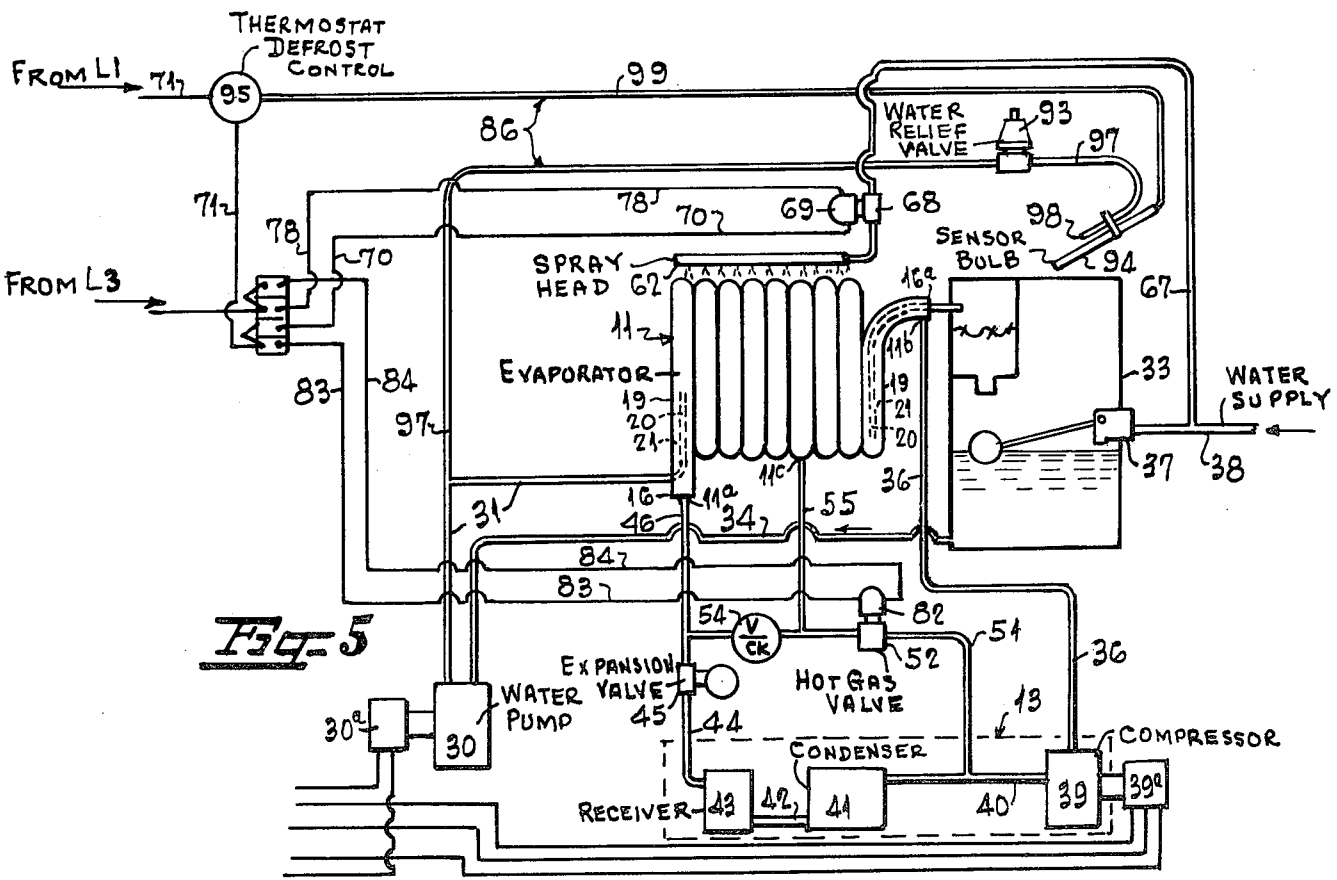
FIG. 5 is a diagrammatic view similar to FIG. 1 illustrating another modified embodiment employing a thermal sensing defrost control assembly 86.

FIG. 5 illustrates another modified form of the invention which is substantially identical to the embodiment shown in FIGS. 1 and 2 except a thermally sensed water pressure switch assembly 86 is substituted for the solid state water level senscontrol assembly.

Assembly 86 includes a water relief valve 93, a thermal sensing element or bulb 94, a thermostat defrost control switch 95, and solenoid valves 82 and 69 responsive to the switch 95 to control the supply of hot gas and tap water to evaporator space 21 and to spray head 62 of the dual acting defrost system during the defrost cycle.

A pipe 97 branches from pump discharge conduit 31, said pipe having an orifice at its other end which is disposed above a thermal sensing bulb 94 and makeup reservoir 33. A water relief valve is mounted by means of a tee in pipe 97 and is subject to the water pressure in conduit 31. A copper tube 99 connects sensing element 94 to the thermostat defrost control 91, the latter being electrically connected to solenoids 82 and 69 by previously described parallel circuits of the dual acting defrost system.

Control switch 95 is also commercially available at Ranco Controls, Inc. and has the following specifications:

| Type 016 | Volts | FLA | LRA |
|---|---|---|---|
| Model 520 | 120 | 20 | 120 |
| Open on Rise | 240 | 17 | 102 |

When a predetermined high pressure in pipes 31 and 97 is created as a result of ice formation in evaporator tube 20, water is released by relief valve 93 so that the water will spray from orifice 98 over sensor bulb 94 which, in turn, activates the contacts in the thermal sensing control 95 to close the contacts thereof and complete the electrical circuits to the dual acting solenoids 82 and 69. When the ice column in the evaporator is defrosted, the ice is ejected by the water pressure, and the reduced pressure on relief valve causes it to close to thereby deactivate the contacts in control 95 and return the mechanism to another freezing cycle.

We claim:

1. In an ice making machine having alternate freezing and defrost cycles and provided with an elongated evaporator (14) consisting of inner and outer tubes (20, 19); means connecting the opposite ends (16, 16a) of said outer tube (19) to the opposite ends of a segment of said inner tube (20) to form a sealed annular chamber (21) between the tubes, the opposite ends of said chamber having inlet and outlet ports (11a, 11b) communicating therewith respectively; pump means for flowing pressurized water through said inner tube (20) during the freezing cycle; and means (39, 46, 36) operable concurrently with said last-named means for flowing a refrigerant fluid through said chamber (21) to bond and form a hollow ice column (22) of progressively increasing thickness upon the inside surface of said inner tube segment, a dual acting defrost system comprising:

means (39, 51, 52) operable upon formation of said ice column (22) to a predetermined wall thickness and during said defrost cycle for flowing a defrost fluid downstream through said chamber (21) in heat exchange with said inner tube (20) to progressively thaw said ice column bond in the same direction, said defrost fluid progressively replacing the refrigerant fluid remaining in the chamber from said freezing cycle, and means (68, 69, 62) operable concurrently with said lastnamed means (39, 51, 52) for continuously flowing a second defrost fluid over said outer tube (19) and in heat exchange with said refrigerant fluid from the freezing cycle being replaced and with the replacing defrost fluid to elevate the temperatures of the two last-named fluids, thereby decreasing the work load of said first defrost fluid and reducing the length of the defrost cycle said second defrost fluid being a relatively warm liquid and said means for flowing said second defrost fluid includes a spray head for distributing said liquid over the entire perimeter and length of said evaporator outer tube.

2. An ice making machine as defined in claim 1 and further comprising means responsive to the pump pressurized water at the inlet to said inner tube for controlling said first and second defrost fluid means, said controlling means including an upright closed reservoir having an air space in its upper portion communicating with a water-receiving space in its lower portion, the lower part of said lower space portion communicating with the pressurized water at said inlet whereby the water will rise and fall in the lower space to exert variable pressure upon the air in the upper space, and a pressure switch responsive to said pressurized air for initiating operation of said dual acting defrost system.

3. An ice making machine as defined in claim 1 wherein the rate of flow of water through said inner tube progressively decreases with said progressively increasing thickness of the ice column, and further comprising means for controlling said two last-named means, said controlling means including a solid state switching device having a high voltage current supply side and a relatively low voltage load side, and liquid level sensing means responsive to a predetermined decreased rate of flow of water through the inner tube and connected to the low voltage load side to energize said dual acting defrost system.

4. An ice making machine as defined in claim 3 wherein said liquid level sensing means consists of an escrow container for receiving the flow of water from said inner tube, means for permitting said received water to flow from the lower portion of said container at a uniform rate concurrently with said water flow into the latter, the rates of flow of water into said escrow container ranging respectively from above to below the uniform rate of flow from the container, and spaced sensing probes disposed in the upper portion of a container and at a level at which said rates of flow into and from the container are substantially identical whereby electrolysis will be eliminated.

5. An ice making machine as defined in claim 1 wherein the rate of flow of water through said inner tube progressively decreases with said progressively increasing thickness of the ice column, and further comprising means for controlling said two last-named means, said controlling means including a solid state switching device having a high voltage current supply side and a relatively low voltage load side, and liquid level sensing means responsive to a predetermined decreased rate of flow of water through said inner tube and connected to the low voltage load side to energize said dual acting defrost system.

6. An ice making machine as defined in claim 5 wherein said liquid level sensing means consists of an escrow container for receiving the flow of water from said inner tube, means for permitting said received water to flow from the lower portion of said container at a uniform rate concurrently with said water flow into the latter, the rates of flow of wate into said escrow container ranging respectively from above to below the uniform rate of flow from the container, and spaced sensing probes disposed in the upper portions of the container and at a level at which said rates of flow into and from the container are substantially equal whereby electrolysis will be eliminated.

7. an ice making machine as defined in claim 1 and further comprising means responsive to the pump pressurized water at the inlet to said inner tube for controlling said two last-named defrost fluid flowing means, said controlling means including an upright closed reservoir having an air space in its upper portion communicating with a water-receiving space in its lower portion, the lower part of said lower space portion communicating with the pressurized water at said inlet whereby the water will rise and fall in the lower space to exert variable pressure upon the air in the upper space, and a pressure switch responsive to said pressured air for initiating operation of said dual acting defrost system.

8. An ice making machine as defined in claim 1 and further comprising thermal sensing means responsive to the temperature of the pressurized water at its inlet to said inner tube for controlling said two last-named means, said controlling means including a temperature sensing element, means operable by a predetermined water pressure at said tube inlet for releasing the pressured water upon said element, and a thermostat control switch responsive to said element for initiating operation of said dual acting defrost system.

9. An ice making machine as defined in claim 1 and further comprising thermal sensing means responsive to the temperature of the pressurized water at its inlet to said inner tube for controlling said two last-named means, said controlling means including a temperature sensing bulb, a water relief valve operable at a predetermined water pressure at said tube inlet for releasing the pressured water upon said bulb, and a thermostat control switch responsive to said bulb to initiate the operation of said dual acting defrost system.

* * * * *